US005130688A

United States Patent [19]

Van Rietschoten et al.

[11] Patent Number: 5,130,688

[45] Date of Patent: Jul. 14, 1992

[54] FUSE

[75] Inventors: Pierter J. Van Rietschoten, Houten; Dirk De Kler, Loosdrecht; Leendert Vermij, Buren, all of Netherlands

[73] Assignee: Littlefuse Tracor B.V., Utrecht, Netherlands

[21] Appl. No.: 521,751

[22] Filed: May 10, 1990

[51] Int. Cl.[5] ..... H01H 85/143

[52] U.S. Cl. ..... 337/231; 337/252; 337/260

[58] Field of Search ..... 337/231, 227, 228, 233, 337/236, 238, 201, 202, 199, 252, 260

[56] References Cited

U.S. PATENT DOCUMENTS

| | | | |
|---|---|---|---|
| 1,377,398 | 5/1921 | Conrad . | |
| 1,700,582 | 1/1929 | Brown | 337/260 |
| 3,845,439 | 10/1974 | Deelman | 337/291 |
| 4,559,514 | 12/1985 | Arikawa | 337/201 |
| 4,563,666 | 1/1986 | Borzoni | 337/252 |
| 4,608,548 | 8/1986 | Borzoni | 337/201 |

FOREIGN PATENT DOCUMENTS

| | | | |
|---|---|---|---|
| 423039 | 11/1937 | Belgium . | |
| 318513 | 4/1918 | Fed. Rep. of Germany . | |
| 762124 | 4/1934 | France . | |
| 230145 | 12/1943 | Switzerland . | |
| 22106 | of 1902 | United Kingdom | 337/231 |
| 583621 | 12/1946 | United Kingdom | 337/231 |

*Primary Examiner*—Harold Broome

*Attorney, Agent, or Firm*—Weingarten, Schurgin, Gagnebin & Hayes

[57] ABSTRACT

A fuse of the miniature or sub-miniature type with a housing of insulating material and having metal points of connection at, or in the vicinity of, two spaced ends thereof for connecting a fuse wire, and a fuse wire secured to the points of connection and stretched between them within the housing. According to the invention, at least one ridge or wall of insulating material is provided between the two points of connection in the housing so that each of the points of connection is, as it were, situated in a separate chamber. The fuse extends across the ridge and makes an angle at the passage across the ridge.

2 Claims, 3 Drawing Sheets

FUSE

FIELD OF THE INVENTION

This invention relates to a fuse comprising a housing of insulating material having metal points of connection at, or in the vicinity of, two spaced ends thereof for connecting a fuse wire to said housing, and a fuse wire secured to said points of connection and stretched between them within the housing.

BACKGROUND OF THE INVENTION

Such a fuse is generally known, for example, from U.S. Pat. No. 3845439. In the known fuse, the points of connection for the fuse wire are the inner surfaces of the respective metal end caps of the fuse. The fuse wire extends more or less in a straight line from one point of connection to the other.

In small fuses, i.e., of the miniature or sub-miniature type, having external dimensions of less than about 12 mm,for which there is a great need, for example, for use in so-called "surface mount" technology, problems are encountered with the conventional fuse configurations, if the fuse should have a relatively high blowout threshold, that is to say, a fuse suitable for high amperages (in the order of 100 A and higher) at high voltages (of, for example, 125 V or more DC or AC). When such fuses blow, arcing occurs. Arcing is necessary for a proper operation of the fuse, but the phenomenon should be properly controlled. Thus it should be ensured that the arc does not leave the confines of the fuse. It becomes more difficult to control the arc as the dimensions of the fuse are decreasing. In small fuses, the fuse wire has a short length and, to achieve good blowout characteristics, high arc voltages should occur per centimeter of fuse wire. The use of a filling of arc-extinguishing material, such as fine sand, is known for control of the arc, but cannot be used in fuses designed to be made by more or less fully automated manufacturing techniques. Up until now, quite a different route has been followed in miniature fuses to achieve the object contemplated. Thus in U.S. Pat. No. 4608548, a miniature fuse is described in which protection against housing explosion under fuse conditions is provided by means of arc barrier forming shroud members formed by confronting rigid arc barrier walls of base and cover members between which end terminals of the fuse are sandwiched.

SUMMARY OF THE INVENTION

It is an object of the present invention to provide a fuse which may have very small dimensions, while nevertheless the phenomenon of arcing can be excellently controlled therein, and if desired, the fuse can be made by means of automated manufacturing techniques. This object is achieved, according to the present invention, by providing a fuse of the miniature or sub-miniature type in which at least one ridge or wall of insulating material is provided between the two points of connection in the housing, so that each of the points of connection is, as it were, situated in a separate chamber, said fuse extending across the top of the ridge or through a more or less narrow slot in the top of the ridge or through a more or less narrow opening in the wall between the points of connection, and making an angle at the passage of the ridge or wall.

By using at least one wall or ridge in the fuse according to the invention, the housing is divided into at least two virtually entirely or substantially separated compartments. The points of connection are disposed in different compartments and, owing to the wall or ridge between them, there is no "line of sight" between them. Indeed, the fuse wire extends not in a straight line from one point of connection to the other, but the fuse wire has at least one "bend" at the wall or ridge. When the fuse according to the invention blows, as a result of its construction, there is not formed a single arc between the points of connection, but as it were two arcs are formed in series, with each arc having only one base point. During arcing, owing to the bend in the fuse wire, the plasma streams are forced into a direction deviating from that in which the fuse extends. Consequently, the plasma streams are not directed to the points of connection and cannot exit through such points of connection. As a result of the fact that the direction of the plasma stream of the arc differs from that of the fuse wire, an enlarged energy transfer from the arc and easier cooling turn out to be possible. A further advantage of the bend in the fuse at the passage of the wall or ridge is that the fuse may have a longer length than in fuses of comparable dimensions without an intermediate wall or ridge in the housing. As a consequence, a higher arc voltage is possible, while the fuse is less sensitive to heat transfer to the ends.

In a suitable embodiment of the fuse according to the invention, the housing is comprised of a bottom section of insulating material, in or at the ends of which the metal points of connection are secured, and in the middle of which the ridge or wall is erected, and of a cover of insulating material secured onto, or over, the bottom section. Preferably, in that embodiment, the metal points of connection form part of metal strip members embedded in the bottom of the housing, said strip members serving at the same time for external connection, said strip members being optionally folded over around the cover to serve partly for keeping the cover secured to the bottom. Outside the housing, however, the strip members may have any other suitable form, for example, to make the fuse suitable for so-called "through-hole" print mounting.

DESCRIPTION OF THE DRAWINGS

Some embodiments of the invention will now be described by way of example, with reference to the accompanying drawings, in which.

DETAILED DESCRIPTION

Figure 4:
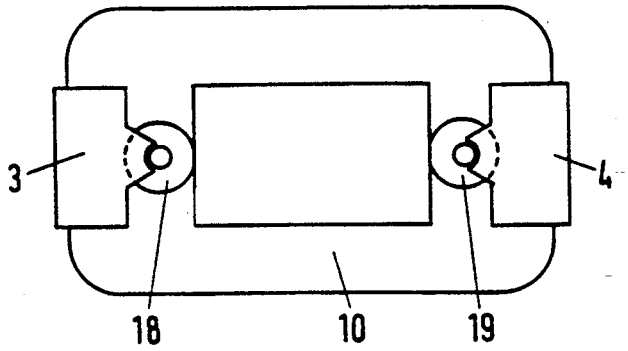
FIG. 4 is a top plan view of the fuse shown in FIG. 1.
Figure 1:
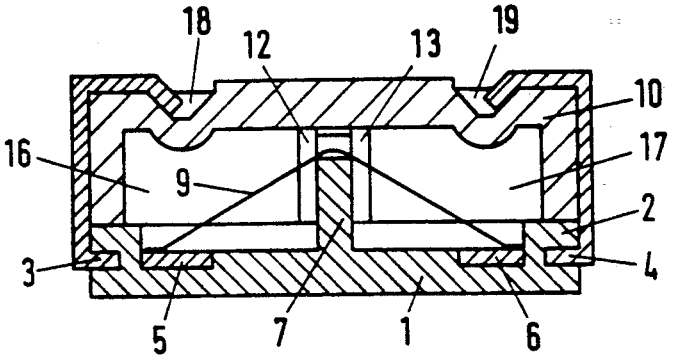
FIG. 1 is a cross-sectional view of one embodiment of the fuse according to the invention.
Figure 2B:
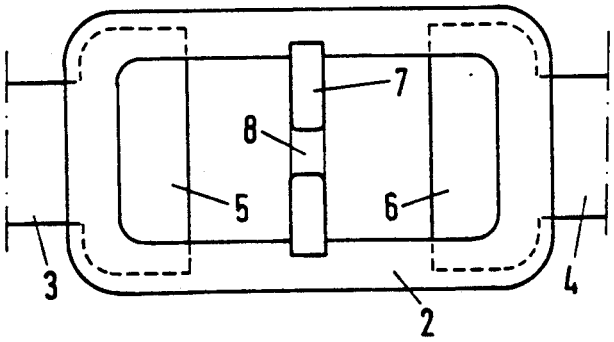
FIGS. 2*a*, 2*b* and 2*c* respectively show a part-sectional side view, a top plan view, and a front view of the bottom section with embedded points of connection of the fuse illustrated in FIG. 1.
Figure 2A:
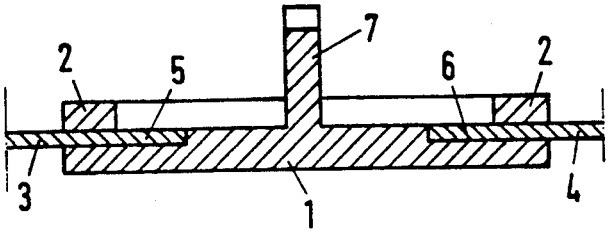
Figure 2C:
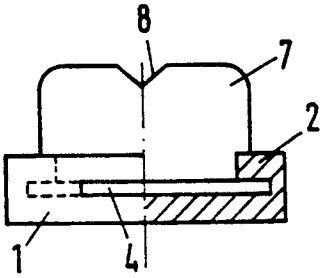
Figure 3A:
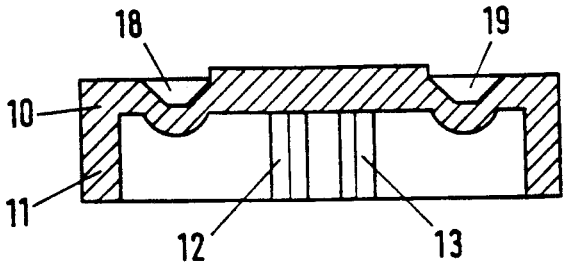
FIGS. 3*a*, 3*b* and 3*c* respectively show a part-sectional side view, a bottom view, and a front view in cross-section of the cover section of the fuse shown in FIG. 1.
Figure 3C:
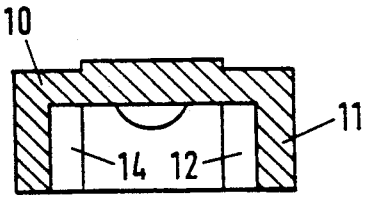
Figure 3B:
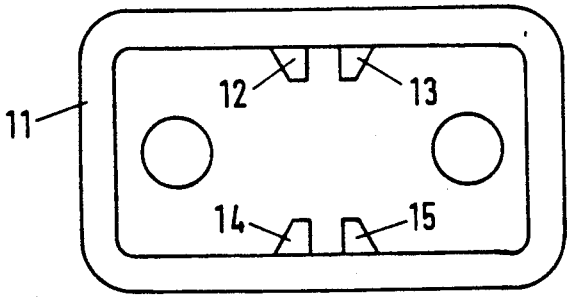

FIGS. 1 to 4 show a first embodiment of the fuse according to the invention. This embodiment comprises a bottom section 1. Bottom section 1 consists of an essentially elongate flat bottom with an upright peripheral edge 2. The bottom section 1 is made, for example, of plastics and can be made by well-known injection moulding techniques. At both ends, metal connector strips 3 and 4 are secured in the bottom section. As shown in FIG. 2*b*, strips 3 and 4 have broadened ends, adapted to the shape of the bottom section at the point where they are secured to the bottom section. Strips 3 and 4 may be embedded in the bottom section in any suitable manner, so that in the container formed by bottom section 1, and defined by the upright edge 2, points of connection 5 and 6 are exposed. In the middle of bottom section 1, an upright wall 7 is provided, which extends transversely to the sides of bottom section 1 and extends from edge to edge. As best shown in FIG. 2*c*, the upright wall 7 is provided with a recessed portion or slot 8 in the middle of the top edge. A fuse wire 9 is secured to points of connection 5 and 6 and extends across wall 7 through the slot 8 therein from one side of bottom section 1 to the other. Fuse wire 9 may be secured to points of connection 5 and 6 in various ways known in the art, such as laser welding or the technique known by the name of "bonding". In the latter technique, the fuse wire is vibrated with high-frequency energy at the point of connection. Owing to the friction, the material is locally molten and welded. The bond thus obtained can be covered with a bead of epoxy resin, silicones or similar suitable insulating material. Secured to bottom section 1 is a cover 10. Cover 10 essentially consists of a container with an upright peripheral flange or rim 11. The dimensions and shape of the cover 10 are such that the upright flange 11 fits exactly on the upright edge 2 of bottom section 1. In the container defined by rim 11 two ribs 12 and 13 and 14 and 15, respectively, extend inwardly from rim 11 on opposite sides approximately in the middle of the sides. Ribs 12 and 13 and ribs 14 and 15 leave just sufficient space between them to accommodate the upright wall 7 of bottom section 1 when cover 10 is secured to bottom section 1. In this way, as shown in FIG. 1, the housing of the embodiment of the fuse according to the invention shown consists of two virtually entirely separate compartments 16 and 17. The only connection between compartments 16 and 17 is slot 8 in the top of wall 7, and possibly a slight interspace between the top of wall 7 and cover 10.

Provided in the top of cover 10, on the outside thereof, are two more or less circular recessed portions 18 and 19. These recesses 18 and 19 are approximately centrally over the respective points of connection 5 and 6 when the fuse has been mounted. Bottom section 1 and cover 10 are secured together in a suitable manner in practice, for example, by means of ultrasonorous welding or by means of a suitable adhesive. The connecting strips 3 and 4 are folded around cover 10, so that the respective, suitably formed ends of strips 3 and 4 engage precisely in recesses 18 and 19, all this as shown in FIG. 1.

Figure 5:
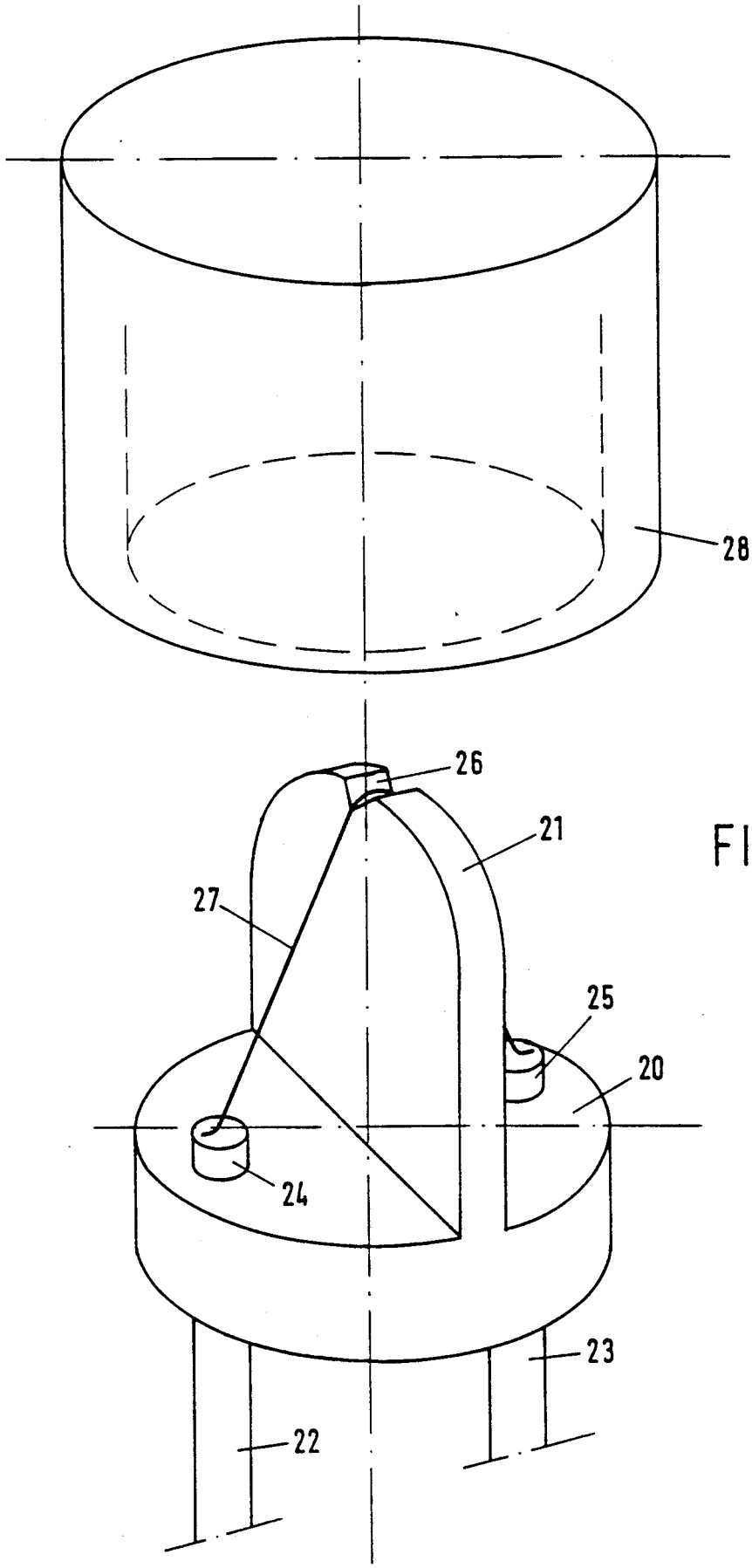
FIG. 5 schematically shows a different embodiment of the fuse according to the invention.

FIG. 5 illustrates a different embodiment of the fuse according to the invention. This embodiment comprises a bottom section essentially consisting of a round disc-shaped platform 20 of a suitable plastics material divided into two approximately equal parts by an upright wall 21. Projecting from the bottom of disc 20 through the disc are two metal connector pins 22 and 23, so that the end 24 of pin 22 is on one side of wall 21 and the end 25 of pin 23 on the other. In the top of wall 21, a recessed portion or slot 26 is provided. A fuse wire 27 extends from end 24 of pin 22 through slot 26 in wall 21 to the end 25 of pin 23. The connection of fuse wire 27 to the metal points of connection 24 and 25 can be realized in any suitable manner, for example, by soldering.

Fitting over disc 20 with wall 21 and fuse wire 27 is a cover 28 which in FIG. 5 is shown spaced from the bottom section. Cover 28 is formed to fit exactly over and around disc 20, so that an hermetically sealed housing is obtained by glueing or the like. Within cover 28, wall 21 extends upwardly to such an extent as to form two virtually separate compartments, each of which contains a point of connection for fuse wire 27.

Figure 6:
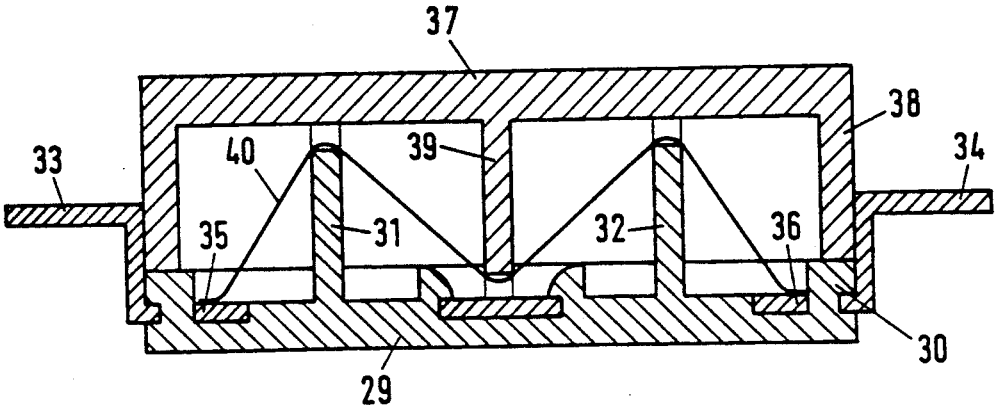
FIG. 6 shows yet another embodiment of the fuse according to the invention in cross-section. In the figures, like parts are designated by like reference numerals.

FIG. 6 illustrates still another embodiment of the fuse according to the invention in diagrammatic form. This embodiment comprises a bottom section 29 with a peripheral upright edge or flange 30 and two intermediate walls 31 and 32 erected at one-quarter and at approximately three-quarters of the length transversely to the longitudinal direction. In bottom section 29, connector strips 33 and 34 are embedded so as to leave exposed a point of connection 35 of strip 33 and a point of connection 36 of strip 34 within the container defined by bottom section 29 and rim 30. Secured to bottom section 29 is cover 37, for example, by glueing. Cover 37, of a suitable plastics material, comprises a flat cover portion and a depending flange 38 extending along the circumference of the flat portion, and the dimensions of which match those of the upright flange 30 of bottom section 29. In the middle of cover 37, a depending intermediate wall 39 is provided to extend transversely to the longitudinal direction thereof. As shown in FIG. 6, the housing of the fuse is divided by the partitions 31, 32 and 39 into four virtually separated compartments. A fuse wire 40 is stretched between the points of connection 35 and 36 and extends zig-zag wise through the four compartments through suitable slots or openings in the top edge of partition 31, the bottom edge of partition 39 and the top edge of partition 32, respectively.

The advantage of the erection of at least one partition or intermediate wall in the housing of a fuse, in accordance with the present invention, so as to provide at least two virtually separate compartments therein, with the points of connection for the fuse wire being located in different compartments, resides, among other factors, in the fact that this increases the length of the fuse wire, so that a higher arc voltage is possible, while the fuse is less vulnerable to heat transfer to the ends of the fuse wire. In an embodiment as shown in FIG. 1, for example, with a total length of the fuse of about 7 mm, the length of the fuse wire is about 6.5 mm.

A further advantage is that during arcing when the fuse blows, the plasma rays are, as it were, forced out of the slot or opening in the partition in a direction materially deviating from the direction in which the fuse wire extends itself. This means enhanced transfer of energy from the arc, so that better cooling is possible.

Experiments have been conducted with an embodiment of the fuse according to this invention as illustrated in FIG. 1, with dimensions of about 7 mm long, 4 mm wide and 2.8 mm high. Such a fuse exhibited an arc voltage which was properly controllable, was virtually constant throughout the entire arcing period, and was approximately 300 V. The fuse reliably interrupted a current of 150 A at 150 V DC.

The fuse as illustrated in FIGS. 1–4, in particular, lends itself excellently to fully automated production, with the metal parts being embedded in the plastic housing by means of the "insert moulding" technique. It will be clear that many variants of the fuse according to the invention can be conceived and designed without departing from the scope of the present invention. One possible variant, for example, is the use of a removable partition rather than one formed integrally with the bottom section.

We claim:

1. A miniature fuse comprising:

a housing of insulating material having metal points of connection adjacent to two spaced ends thereof, a fuse wire laser bonded to said housing such that said fuse wire is secured to said points of connection and stretched between them within the housing;

at least one ridge of insulating material provided between said points of connection in the housing, so that each of said points of connection is situated in at least one separate hollow chamber, said fuse wire extending through said at least one separate hollow chamber and across the top of said at least one ridge through a slot in the top thereof between said points of connection, and making an angle at a passage of said at least one ridge.

2. A miniature fuse comprising:

a housing of insulating material having metal points of connection adjacent to two spaced ends thereof for connecting a fuse wire to said housing such that said fuse wire is secured to said points of connection and stretched between them within the housing;

at least one ridge of insulating material provided between said points of connection in the housing, so that each of said points of connection is situated in at least one separate hollow chamber, said fuse wire extending through said at least one separate hollow chamber and across the top of said at least one ridge through a slot in the top thereof between said points of connection, and making an angle at the passage of said at least one ridge;

a bottom section of insulating material wherein said metal points of connection are secured and in which said at least one ridge is erected; and a cover of insulating material secured to said bottom section, wherein said points of connection form part of at least one metal strip member embedded in said bottom of the housing, said at least one metal strip member providing an external connection; and said at least one metal strip member being folded over around said cover to provide for keeping said cover secured to said bottom.

* * * * *